US009111701B2

(12) United States Patent
Tanizaki et al.

(10) Patent No.: US 9,111,701 B2
(45) Date of Patent: Aug. 18, 2015

(54) RUBBER KEY

(71) Applicant: BROTHER KOGYO KABUSHIKI KAISHA, Nagoya-shi, Aichi-ken (JP)

(72) Inventors: Masashi Tanizaki, Kuwana (JP); Shinji Kobayashi, Tokoname (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 166 days.

(21) Appl. No.: 13/625,895

(22) Filed: Sep. 25, 2012

(65) Prior Publication Data

US 2013/0168219 A1 Jul. 4, 2013

(30) Foreign Application Priority Data

Dec. 28, 2011 (JP) ..... 2011-288127

(51) Int. Cl.
*H01H 13/52* (2006.01)
*H01H 13/705* (2006.01)
*H01H 13/14* (2006.01)

(52) U.S. Cl.
CPC ..... *H01H 13/705* (2013.01); *H01H 2221/002* (2013.01); *H01H 2221/05* (2013.01); *H01H 2221/072* (2013.01); *H01H 2227/016* (2013.01)

(58) Field of Classification Search
CPC ..... H01H 13/705; H01H 13/52; H01H 13/14
USPC ..... 200/341, 521, 513, 314; 400/490
See application file for complete search history.

(56) References Cited

U.S. PATENT DOCUMENTS

| | | | | |
|---|---|---|---|---|
| 5,389,757 | A * | 2/1995 | Souliere | 200/345 |
| 6,750,415 | B2 * | 6/2004 | Yamagami | 200/517 |
| 7,109,431 | B2 * | 9/2006 | Yanai et al. | 200/512 |
| 7,285,741 | B2 * | 10/2007 | Kato | 200/513 |

FOREIGN PATENT DOCUMENTS

| | | |
|---|---|---|
| JP | H09231858 | 9/1997 |
| JP | 2002124152 | 4/2002 |
| JP | 2001-318414 | 11/2011 |

OTHER PUBLICATIONS

Japanese Office Action issued in Application No. 2011-288127 on May 26, 2015.

* cited by examiner

*Primary Examiner* — Renee S Luebke
*Assistant Examiner* — Ahmed Saeed
(74) *Attorney, Agent, or Firm* — Gerald Levy; McCarter & English, LLP

(57) ABSTRACT

A rubber key comprising: a key top portion having a rectangular shape in planar view; a skirt portion formed along a perimeter of the key top portion; and a contact portion projecting within the skirt portion from the key top portion on a same side of the skirt portion in a convex state in a length direction of the key top portion, wherein a shortest distance from the contact portion to a virtual plane defined by a ring of an edge of the skirt portion is longer as measured at a portion closer to a center of the key top portion in the length direction than at a portion closer to an end of the key top portion in the length direction.

10 Claims, 4 Drawing Sheets

RUBBER KEY

CROSS REFERENCE TO RELATED APPLICATIONS

The present application claims priority from Japanese Patent Application No. JP 2011-288127, which was filed on Dec. 28, 2011, the disclosure of which is incorporated herein by reference in its entirety.

TECHNICAL FIELD

The disclosure relates to a rubber key, of which a key top portion is rectangular-shaped in planar view.

BACKGROUND

As a rubber key, there has been conventionally known a two-step push button that operates accurately and has large tolerance to an oblique press. The two-step push button is provided with a metal cap, which is a kind of a rigid-body cap. Accordingly, when the button provided with the metal cap is pushed down, whichever area of the button provided with the metal cap is pushed, clear tactile sensation is presented, as the entire metal cap is depressed.

However, in such a rubber key whose key top portion is rectangular-shaped in planar view, if the key top portion is not a rigid body, the clear tactile sensation cannot be presented depending on the area pushed down, as the key top portion rectangular-shaped in planar view is deformed at the depression of the key top portion.

SUMMARY

The disclosure has been made to solve the above-described problem and has an object to provide a rubber key that presents clear tactile sensation to a user, whichever portion of the key top portion rectangular-shaped in planar view is pushed down.

To achieve the purpose of the disclosure, there is provided a rubber key comprising: a key top portion having a rectangular shape in planar view; a skirt portion formed along a perimeter of the key top portion; and a contact portion projecting within the skirt portion from the key top portion on a same side of the skirt portion in a convex state in a length direction of the key top portion, wherein a shortest distance from the contact portion to a virtual plane defined by a ring of an edge of the skirt portion is longer as measured at a portion closer to a center of the key top portion in the length direction than at a portion closer to an end of the key top portion in the length direction.

DETAILED DESCRIPTION

A detailed description of an exemplary embodiment of a rubber key embodying the disclosure will now be given referring to the accompanying drawings.

1. Configuration of the Embodiment

Figure 1:
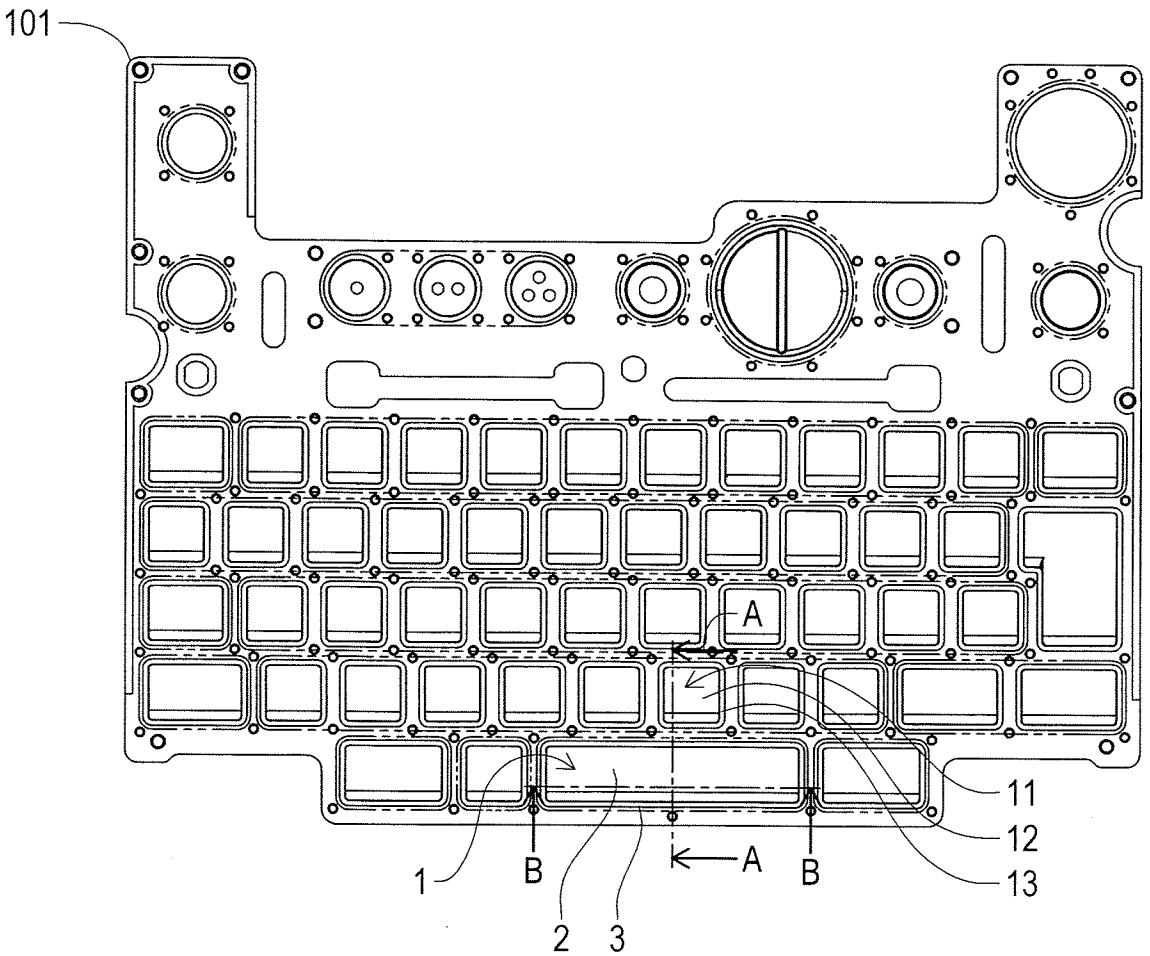
FIG. 1 is a planar view seen from a top side of a rubber keyboard sheet.
Figure 2:
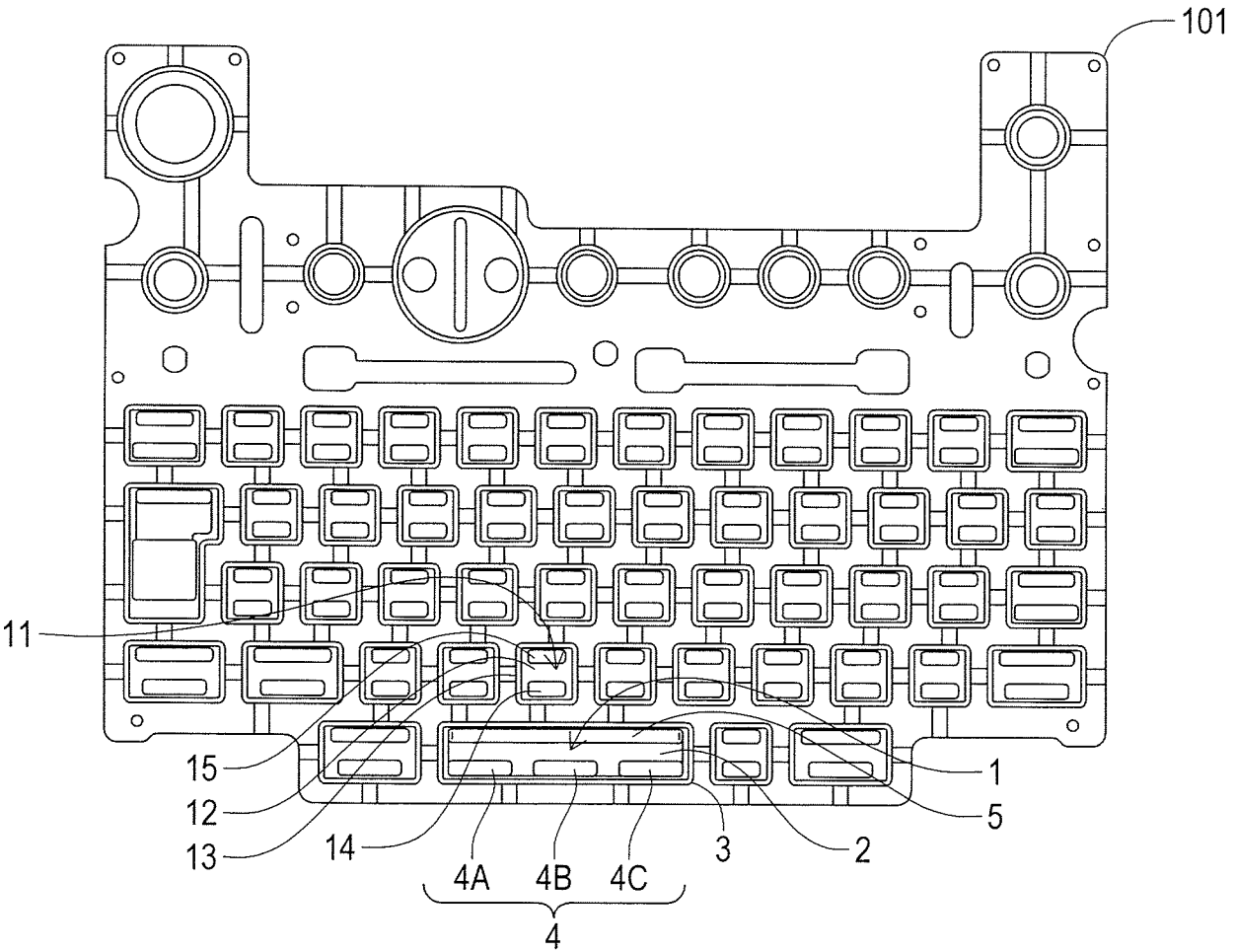
FIG. 2 is a planar view seen from a back side of the rubber keyboard sheet stripped of a substrate.

As shown in FIG. 1 and FIG. 2, a rubber keyboard sheet 101 is provided with a plurality of rubber keys including a rubber key 1 according to the exemplary embodiment of the disclosure. The rubber key 1 according to the exemplary embodiment includes a key top portion 2 and a skirt portion 3. The key top portion 2 has a rectangular shape in planar view. The skirt portion 3 is arranged along the perimeter of the key top portion 2. Further, the skirt portion 3 is fixed on a substrate 102, as shown in FIG. 3 and FIG. 4.

Figure 3:
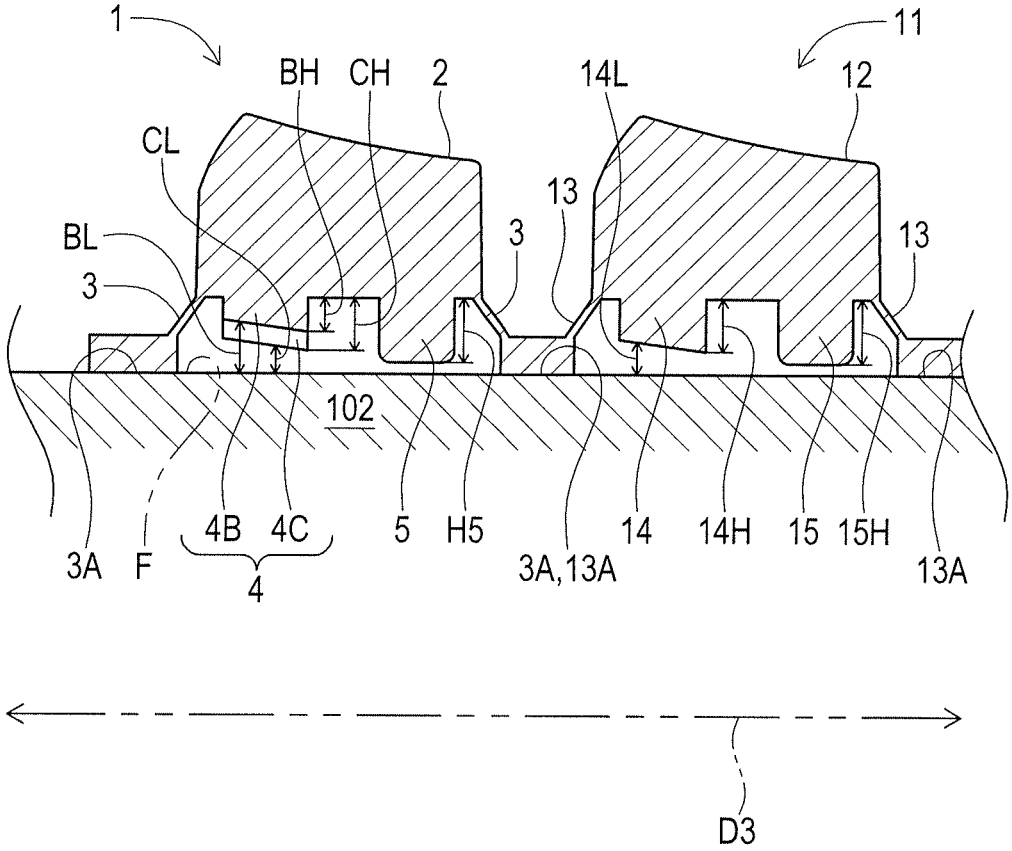
FIG. 3 is a partial cross-sectional view of the rubber keyboard sheet taken in a direction of arrows A-A of FIG. 1.
Figure 4:
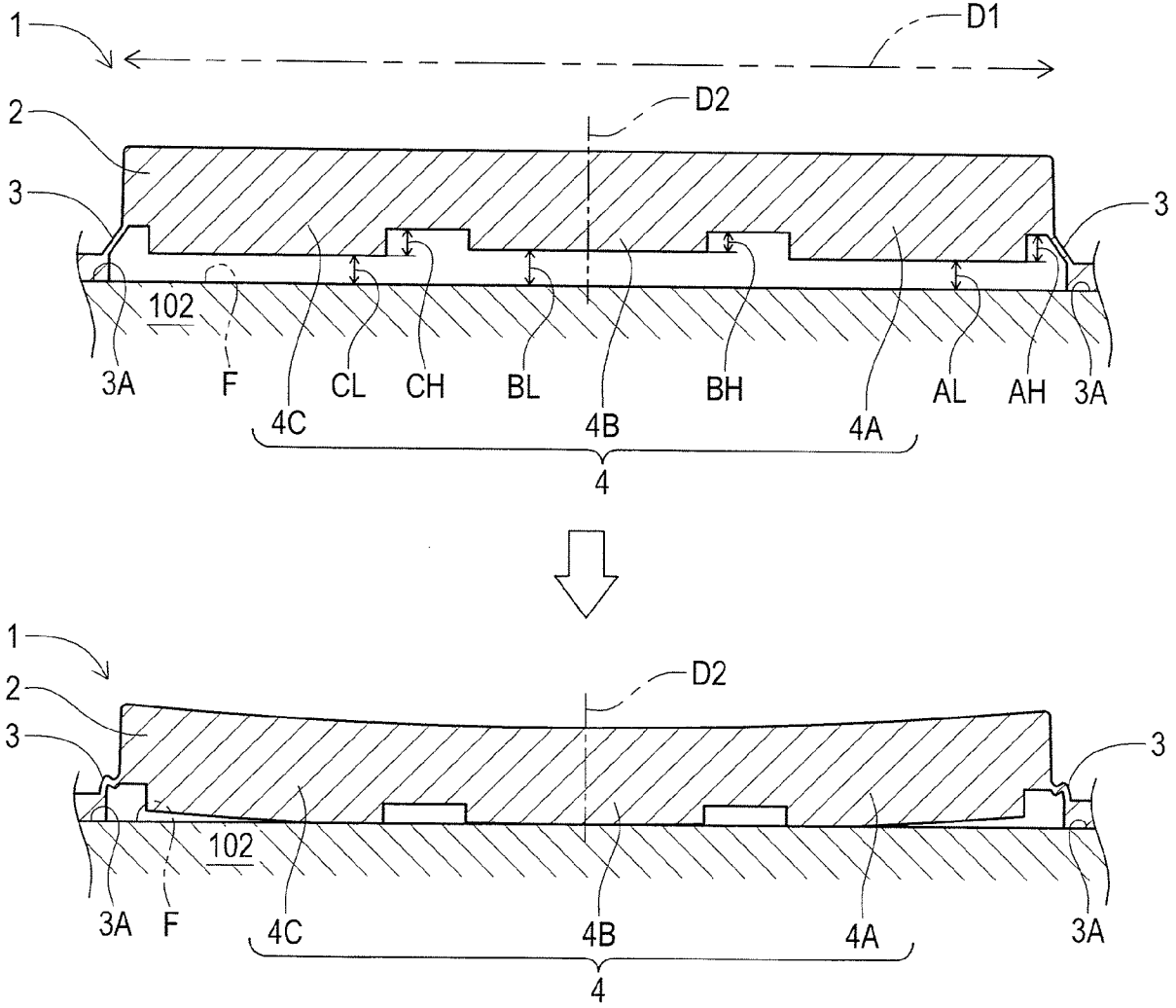
FIG. 4 is a partial cross-sectional view of the rubber keyboard sheet taken in a direction of arrows B-B of FIG. 1, showing a rubber key according to one embodiment of the disclosure in sectional view.

Furthermore, as shown in FIG. 2 through FIG. 4, the rubber key 1 according to the embodiment is provided with a contact portion 4 and a support portion 5. The contact portion 4 is composed of a first projecting portion 4A, a second projecting portion 4B, and a third projecting portion 4C. The first projecting portion 4A, the second projecting portion 4B, and the third projecting portion 4C project on the same side as the skirt portion 3, within the skirt portion 3 from the undersurface of the key top portion 2, and are formed each in a convex manner along a length direction D1 (See FIG. 4) of the key top portion 2. That is, the first projecting portion 4A, the second projecting portion 4B, and the third projecting portion 4C are arranged in line along one long side (lower side in FIG. 2) of the key top portion 2 rectangular-shaped in planar view.

The first projecting portion 4A and the third projecting portion 4C are positioned on both sides of the key top portion 2 in the length direction D1, respectively. A projection height AH at the first projecting portion 4A is even in the length direction D1 of the key top portion 2. A projection height CH at the third projecting portion 4C is even in the length direction D1 of the key top portion 2. Further, the projection height AH at the first projecting portion 4A is the same height as the projection height CH at the third projecting portion 4C.

The second projecting portion 4B is positioned at the center of the key top portion 2 in the length direction D1. A projection height BH at the second projecting portion 4B is even in the length direction D1 of the key top portion 2. Further, a projection height BH at the second projecting portion 4B is lower than the projection height AH at the first projecting portion 4A or the projection height CH at the third projecting portion 4C.

A projection height of the contact portion 4 composed of the first projecting portion 4A, the second projecting portion 4B, and the third projecting portion 4C is thus made lower at a portion closer to a center line D2 (see FIG. 4) of the key top portion 2 with respect to the length direction D1 than portions at both ends of the key top portion 2 in the length direction D1.

Incidentally, carbon is printed on each tip of the first projecting portion 4A, the second projecting portion 4B and the third projecting portion 4 composing the contact portion 4C, to form a conductive portion.

The support portion 5 is formed in a convex shape along the length direction D1 of the key top portion 2, protruding from the key top portion 2 inside the skirt portion 3. The support portion 5 is parallel with the first projecting portion 4A, the second projecting portion 4B, and the third projecting portion 4C composing the contact portion 4. That is, the support portion 5 is formed in a linear shape along the other long side (upper side in FIG. 2) of the key top portion 2 having the rectangular shape in planar view.

Furthermore, as shown in FIG. 2, the support portion 5 is arranged side by side with the first projecting portion 4A, the second projecting portion 4B and the third projecting portion 4C composing the contact portion 4 with respect to a breadth direction D3 (see FIG. 3) of the key top portion 2.

A projection height H5 (see FIG. 3) of the support portion 5 is even in the length direction D1 of the key top portion 2. The projection height H5 of the support portion 5 is higher than any of the projection heights AH, BH, CH at the first projecting portion 4A, the second projecting portion 4B, and the third projecting portion 4C composing the contact portion 4.

The undersurface of the key top portion 2 is substantially flat. Accordingly, the shortest distance (interval) from the undersurface of the key top portion 2 to the substrate 102 is substantially the same at any location in the undersurface of the key top portion 2. Furthermore, with respect to the shortest distance (interval) from the contact portion 4 to the substrate 102, the shortest distance measured at the second projecting portion 4B is longer than the shortest distance measured at the first projecting portion 4A or the third projecting portion 4C.

Here, as shown in FIG. 3 or FIG. 4, a ring of a lower edge 3A of the skirt portion 3 defines a virtual plane F which overlaps the surface of the substrate 102. Accordingly, with respect to the shortest distance (interval) from the contact portion 4 to the virtual plane F, the shortest distance (interval) is longer as measured at the second projecting portion 4B than at the first projecting portion 4A or the third projecting portion 4C. That is, a shortest distance of a distance BL at the second projecting portion 4B is longer than a shortest distance of a distance AL at the first projecting portion 4A or a shortest distance of a distance CL at the third projecting portion 4C. The shortest distance of the distance AL at the first projecting portion 4A is the same as the shortest distance of the distance CL at the third projecting portion 4C. Accordingly, the shortest distance (interval) from the contact portion 4 to the virtual plane F is longer at a portion closer to the center line D2 of the key top portion 2 with respect to the length direction D1 than at portions on both ends in the length direction D1 of the key top portion 2.

Further, as shown in FIG. 3, the distance (interval) from the contact portion 4 to the virtual plane F is configured to gradually increase as measured from a side thereof closer to the support portion 5 to a side farther away from the support portion 5 in the breadth direction D3 of the key top portion 2. That is, the distance BL at the second projecting portion 4B and the distance CL at the third projecting portion 4C are configured to gradually increase as measured toward a side thereof farther away from the support portion 5 with respect to the breadth direction D3 of the key top portion 2. The same can be applied to the distance AL at the first projecting portion 4A whose shortest distance is the same distance (interval) as the shortest distance CL at the third projecting portion 4C.

Further, as shown in FIG. 3, the top surface of the key top portion 2 is configured to slope gradually upward from the side where the support portion 5 is provided toward the side where the contact portion 4 is provided with respect to the breadth direction D3 of the key top portion 2.

Incidentally, the rubber key 1 is made of a single rubber except the portion of carbon print, and the difference in thickness makes the difference in stiffness.

2. Operation of the Disclosure

In the rubber key 1 according to the embodiment, when the key top portion 2 is pushed down, the support portion 5 first makes contact with the substrate 102. Thereafter, the first projecting portion 4A, the second projecting portion 4B, and the third projecting portion 4C composing the contact portion 4 move using the point where the support portion 5 has made contact with the substrate 102 as the point of support for the movement, to make contact with the substrate 102. That is, the rubber key 1 according to the embodiment operates like a so-called piano-style key.

As shown in FIG. 4, when the key top portion 2 of the rubber key 1 according to the embodiment is pushed down while the skirt portion 3 is fixed on the substrate 102, the contact portion 4 projecting from the key top portion 2, in other words, the first projecting portion 4A, the second projecting portion 4B, and the third projecting portion 4C move to make contact with the substrate 102.

Here, the projection height of the contact portion 4 composed of the first projecting portion 4A, the second projecting portion 4B, and the third projecting portion 4C is formed to be lower at the portion closer to the center line D2 of the key top portion 2 having the rectangular shape in planar view with respect to the length direction D1 than at portions on the both ends of the key top portion 2 rectangular-shaped in planar view in the length direction D1. That is, the height of the contact portion 4 is formed to vary with location in one rubber key 1.

Accordingly, the shortest distance (interval) from the contact portion 4 to the virtual plane F defined by the ring of the edge 3A of the skirt portion 3 is longer as measured at the portion closer to the center line D2 of the key top portion 2 in the length direction D1 than at the portions on both ends in the length direction D1 of the key top portion 2. That is, in this case, the distance that the contact portion 4 including the first projecting portion 4A, the second projecting portion 4B and the third projecting portion 4C has to cover to make contact with the substrate 102 is longer at the portion closer to the center line D2 of the key top portion 2 having the rectangular shape in planar view in the length direction D1 than at the portions on both ends of the key top portion 2 having the rectangular shape in planar view in the length direction D1.

As a result, the skirt portion 3 at the perimeter of the key top portion 2 having the rectangular shape in planar view in the length direction D1 buckles, not only in a case a user presses an end portion on the top surface thereof the key top portion 2 having the rectangular shape in planar view in the length direction D1, but also in a case the user presses the center of the key top portion 2 having the rectangular shape in planar view in the length direction D1, as shown in FIG. 4, so that the key top portion 2 having the rectangular shape in planar view presents an excellent tactile sensation to the user.

In other words, in the rubber key 1 according to the embodiment, the key top portion 2 having the rectangular shape in planar view can present an excellent tactile sensation to the user whichever area thereof is pressed.

3. Other

It is to be noted that the disclosure is not restricted to aspects according to the present embodiment and that various changes and modification may be made without departing from the gist of the disclosure.

[3-1. First Alternative Configuration of Contact Portion]

For instance, the contact portion 4 may be composed of four or more projecting portions in such a manner that the projection height of the contact portion 4 is lower at a portion closer to the center line D2 of the key top portion 2 having the rectangular shape in planar view in the length direction D1, than at portions closer to both ends of the key top portion 2 having the rectangular shape in planar view in the length direction D1. Also in this case, the shortest distance (interval) from the contact portion 4 to the virtual plane F defined by the ring of the edge 3A of the skirt portion 3 is longer as measured at the portion closer to the center line D2 of the key top portion 2 with respect to the length direction D1 than at the portions closer to both ends of the key top portion 2 in the length direction D1.

[3-2. Second Alternative Configuration of Contact Portion]

Further, the contact portion 4 may be composed of one projecting portion, in such a manner that the projection height of the contact portion 4 becomes lower toward the center line D2 of the key top portion 2 having the rectangular shape in planar view in the length direction D1, from both ends of the key top portion 2 having the rectangular shape in planar view in the length direction D1. Also in this case, the shortest distance (interval) from the contact portion 4 to the virtual plane F defined by the ring of the edge 3A of the skirt portion 3 becomes longer toward the center line D2 of the key top portion 2 in the length direction D1 from both ends of the key top portion 2 in the length direction D1.

[3-3. Configuration of Support Portion]

The support portion 5 may be configured to always have contact with the substrate 102, regardless of the state of the key top portion 2: being pressed or not pressed.

[3-4. Uniform Tactile Sensation]

Further, the tactile sensation of the rubber key 1 according to the embodiment can be made to be the same as the tactile sensation of any other rubber key in the rubber keyboard sheet 101. Hereinafter, there is discussed a case where the tactile sensation of the rubber key 1 according to the embodiment is made to be the same as the tactile sensation of a rubber key 11 shown in FIG. 1 through FIG. 3.

The rubber key 11 shown in FIG. 1 through FIG. 3 is a rubber key adjacent to the rubber key 1 according to the embodiment, and includes a key top portion 12 and a skirt portion 13. The key top portion 12 has a substantially square shape in planar view. The skirt portion 13 is arranged along the perimeter of the key top portion 12. Further, the skirt portion 13 is fixed on the substrate 102, as shown in FIG. 3.

Further, as shown in FIG. 2 and FIG. 3, the rubber key 11 is provided with a contact portion 14 and a support portion 15. The contact portion 14 projects on the same side of the skirt portion 13, within the skirt portion 13 from the undersurface of the key top portion 12, in a convex and linear shape along the lower side (lower portion in FIG. 2) of the key top portion 12. A projection height 14H of the contact portion 14 is even in a direction along the lower side (lower portion in FIG. 2) of key top portion 12. Incidentally, carbon is printed on the tip of the contact portion 14 to form a conductive portion.

The support portion 15 protrudes within the skirt portion 13 from the undersurface of the key top portion 12, in a convex and linear shape along the upper side (upper portion in FIG. 2) of key top portion 12. That is, the support portion 15 is arranged parallel to the contact portion 14. A projection height 15H of the support portion 15 is even in a direction along the upper side (upper portion in FIG. 2) of the key top portion 12. The projection height 15H of the support portion 15 is higher than the projection height 14H of the contact portion 14.

Accordingly, as shown in FIG. 2, the support portion 15 is arranged side by side with the contact portion 14 with respect to the breadth direction D3 (see FIG. 3) of the key top portion 12.

Further, as shown in FIG. 3, the above-described virtual plane F also serves as a virtual plane defined by a ring of the edge 13A of the skirt portion 13. An interval which is a distance 14L from the contact portion 14 to the virtual plane F is configured to gradually increase as measured from a side thereof closer to the support portion 15 to a side farther away from the support portion 15 of the key top portion 12 in the breadth direction D3.

Further, as shown in FIG. 3, the top surface of the key top portion 12 is configured to slope gradually upward from the side where the support portion 15 is provided toward the side where the contact portion 14 is provided with respect to the breadth direction D3 in the key top portion 12.

In the rubber key 11, when the key top portion 12 is pushed down, the support portion 15 first makes contact with the substrate 102. Thereafter, the contact portion 14 moves using the point where the support portion 15 has made contact with the substrate 102 as the point of support for movement, to make contact with the substrate 102. That is, the rubber key 11 operates like a so-called piano-style key, as well as the rubber key 1 according to the embodiment.

Then, in order to make the tactile sensation at the rubber key 1 according to the embodiment to be the same as the tactile sensation at the rubber key 11, the projection height AH at the first projecting portion 4A and the projection height CH at the third projecting portion 4C in the rubber key 1 according to the embodiment are configured to be the same height as the projection height 14H of the contact portion 14 in the rubber key 11. That is, in the rubber key 1 according to this embodiment, the shortest of the distance AL at the first projecting portion 4A and the shortest of the distance CL at the third projecting portion 4C are configured to be the same distance (interval) as the shortest of the distance 14L of the contact portion 14 in the rubber key 11.

That is, the projection heights AH, CH at the first projecting portion 4A and the third projecting portion 4C in the rubber key 1 according to the embodiment on both sides of the key top portion 2 having the rectangular shape in planar view in the length direction D1 may be set the same height as the projection height 14H of the contact portion 14 in the rubber key 11. That is, in the rubber key 1 according to this embodiment, the shortest distance of the distances AL, CL of the first projecting portion 4A and the third projecting portion 4C positioned on both ends of the key top portion 2 rectangular-shaped in planer view in the length direction D1 can be set in the same distance (interval) as the shortest of the distance 14L of the contact portion 14 in the rubber key 11.

However, there is a requirement that the distance from the undersurface of the key top portion 2 of the rubber key 1 according to the embodiment to the substrate 102 is equal to the distance from the undersurface of the key top portion 12 of the rubber key 11 to the substrate 102, and that at the same time the projection height 5H of the support portion 5 of the rubber key 1 according to the embodiment is equal to the projection height 15H of the support portion 15 of the rubber key 11.

Incidentally, the rubber key 11 is made of the same single rubber except the portion of carbon print, as in the rubber key 1 according to the embodiment, and the difference in thickness makes the difference in stiffness.

[3-4. Omission of Support Portion]

Further, in the rubber key 1 according to the embodiment, even in a configuration not using the so-called piano-style key; namely, even in a configuration in which the support portion 5 is omitted, the key top portion 2 having the rectangular shape in planar view can present an excellent tactile sensation to a user whichever area thereof is pressed.

While presently exemplary embodiments have been shown and described, it is to be understood that this disclosure is for the purpose of illustration and that various changes and modifications may be made without departing from the scope of the disclosure as set forth in the appended claims.

What is claimed is:

1. A rubber key comprising:

a key top portion having a shape of a rectangle having a long side and a short side in planar view;

a skirt portion formed along a perimeter of the key top portion; and a contact portion projecting within the skirt portion from the key top portion on a same side of the skirt portion in a convex state along a long-side direction of the key top portion, wherein a shortest distance from the contact portion to a virtual plane defined by passing through an edge of the skirt portion is longer as measured at a portion closer to a center of the key top portion in the long-side direction of the key top portion than at a portion closer to an end of the key top portion in the long-side direction of the key top portion.

2. The rubber key according to claim 1, wherein, in a state the skirt portion is fixed on a substrate, the contact portion is configured to make contact with the substrate when the key top portion is pressed down.

3. The rubber key according to claim 1 further comprising:

a support portion projecting higher than the contact portion within the skirt portion from the key top portion, in a convex state in the long-side direction of the key top portion and arranged side by side with the contact portion in a short-side direction of the key top portion.

4. The rubber key according to claim 3, wherein, when the key top portion is pressed down in a state the skirt portion is fixed on the substrate and the contact portion is to make contact with the substrate, the contact portion moves using a point where the support portion makes contact with the substrate as a point of support for movement.

5. The rubber key according to claim 3, wherein a top surface of the key top portion is formed to slope gradually upward from a side where the support portion is provided toward a side where the contact portion is provided, with respect to the short-side direction of the key top portion.

6. The rubber key according to claim 3, wherein a distance from the contact portion to the virtual plane defined by passing through the edge of the skirt portion gradually increases as measured from a side of the contact portion closest to the support portion to a side of the contact portion farther away from the support portion in the breadth short-side direction of the key top portion.

7. The rubber key according to claim 1, wherein the contact portion comprises a plurality of projecting portions arranged in line along the long-side direction of the key top portion.

8. The rubber key according to claim 7, wherein a projection height of each of the plurality of projecting portions is even with respect to the long-side direction of the key top portion.

9. A rubber key comprising:

a first key; and a second key, wherein the first key comprising:

a first key top portion having a shape of rectangle having a long side and a short side in planar view;

a first skirt portion formed along a perimeter of the first key top portion; and a first contact portion projecting from the first key top portion within the first skirt portion in a convex state, the first contact portion being providing along a long-side direction of the first key top portion, wherein the second key comprising:

a second key top portion having a shape of square having a first side and a second side in planar view, the first side being parallel to the long side, and the second side being parallel to the short side;

a second skirt portion formed along a perimeter of the second key top portion; and a second contact portion projecting from the second key top portion within the second skirt portion in a convex state, the second contact portion being providing along a first side direction of the second key top portion, wherein the first skirt portion of the first key and the second skirt portion of the second key have a common lower edge, wherein the common lower edge defines a virtual plane, the virtual plane and the first contact portion define a first gap therebetween at a portion closer to a center of the first key top portion in the long-side direction, the virtual plane and the first contact portion define a second gap therebetween at a portion closer to an end of the first key top portion in the long-side direction, and the first gap being longer than the second gap, wherein the virtual plane and the second contact portion define a third gap therebetween at a portion of the second key top portion in the first side direction, the third gap being equal to the first gap.

10. The rubber key according to claim 9, wherein the first contact portion comprises a plurality of projecting portions arranged in line along the long-side direction of the first key top portion.

* * * * *